US006365808B1

(12) United States Patent
Murrell

(10) Patent No.: US 6,365,808 B1
(45) Date of Patent: Apr. 2, 2002

(54) METHOD OF CONSTRUCTING STRINGED INSTRUMENTS

(76) Inventor: Paul Murrell, 1650 Witt Hill Dr., Spring Hill, TN (US) 37174

( * ) Notice: Subject to any disclaimer, the term of this patent is extended or adjusted under 35 U.S.C. 154(b) by 0 days.

(21) Appl. No.: 09/522,547

(22) Filed: Mar. 10, 2000

(51) Int. Cl.[7] ..... G10D 1/08
(52) U.S. Cl. ..... 84/267; 84/290
(58) Field of Search ..... 84/267, 290, 293, 84/298, 312 R

(56) References Cited

U.S. PATENT DOCUMENTS

| | | | | | |
|---|---|---|---|---|---|
| 4,142,436 | A | * | 3/1979 | Chapman | 84/1.16 |
| 4,483,233 | A | | 11/1984 | Benson | |
| 4,649,789 | A | * | 3/1987 | Wadatsu | 84/298 |
| 4,856,404 | A | * | 8/1989 | Hughes, Sr. | 84/297 R |
| 5,175,387 | A | * | 12/1992 | Greory | 84/267 |
| 5,485,773 | A | | 1/1996 | Devitrysmith | |
| 5,581,043 | A | * | 12/1996 | Bowar | 84/291 |
| 5,760,320 | A | | 6/1998 | Gooday | |
| 5,780,758 | A | | 7/1998 | McGill | |
| 5,801,319 | A | | 9/1998 | Hebestreit et al. | |

OTHER PUBLICATIONS

Grove's Dictionary and Music and Musicians, p. 847, 1954.*

* cited by examiner

*Primary Examiner*—Robert E. Nappi
*Assistant Examiner*—Kim Lockett
(74) *Attorney, Agent, or Firm*—David B. Pieper; Waddey & Patterson, P.C.

(57) ABSTRACT

A stringed instrument with a plurality of strings arranged in a non-size sequential order to achieve new string arrangements. This invention teaches a tuned string arrangement for a stringed instrument or guitar with the tuned string arrangement utilizing a tuning sequence of 'high e', 'high a', 'd', 'g', 'low B', and 'low E'. The standard prior art sequence of four guitar strings are reversed with 'low E' string and 'high e' string reversed in position, and the 'low A' string and 'high b' string reversed in position. The 'low A' string is tuned to a 'low B' note one tone higher than the original 'low A' note and the 'high b' string is tuned to a 'high a' note one tone lower than the original 'high b' note. Thus, a non-size sequence of strings is taught for new musical intervals between the strings. For playing purposes, the instrument is played as if the strings have not been relocated from their original positions. The stringed instrument of the instant invention is thus played in the normal technique, i.e. conventional fingering, while allowing the player to elicit altered pitch levels from the partially reversed order of the strings. This revised positioning allows the player to produce heretofore unattainable melodies and harmonies without learning new fingering positions or playing techniques. Revised hardware is also provided for the reversal of the string positions, such as changes in the notches and apertures of the bridge and nut which are modified to maintain the strings in the revised sequence.

9 Claims, 3 Drawing Sheets

METHOD OF CONSTRUCTING STRINGED INSTRUMENTS

BACKGROUND OF THE INVENTION

The present invention relates generally to constructing stringed instruments. More particularly, this invention pertains to constructing stringed instruments, such as guitars, in a manner that varies the order of the placement of the strings in order to produce new and novel sounds while playing the instrument in a conventional method.

As shown in FIGS. 1 and 2, there is illustrated a conventional stringed instrument 10, illustrated in the preferred embodiment as a guitar 10, for purposes of this description. Stringed instruments 10 such as guitars are constructed generally of an amplification body section 12, a narrow and elongated fingerboard 14, a head 16, supporting elements commonly referred to as a bridge 18 and a nut 20, and strings 15. The strings 15 include six strings tuned in order to define a 'low E' string 22, a 'low A' string 24, a 'd' string 26, a 'g' string 28, a 'high b' string 30, and a 'high e' string 32 respectively.

The strings 15 are attached in size-sequential order to the stringed instrument 10. The tuned strings are constructed to produce individual notes and thus the names correspond to the tuned notes, i.e. 'low E' string 22 means a string tuned to the 'low E' note and likewise for the 'low A' string 24, 'd' string 26, 'g' string 28, 'high b' string 30, and 'high e' string 32. In this size sequential sequence, the 'low E' string 22 is constructed with the greatest or widest diameter, and each succeeding string is constructed with a lesser diameter until the 'high e' string 32, which is constructed with the least or narrowest diameter. For a typical setup, the 'low E' string 22 has a diameter of 0.046 inches, the 'low A' string 24 has a diameter of 0.036 inches, the 'd' string 26 has a diameter of 0.026 inches, the 'g' string 28 has a diameter of 0.017 inches, the 'high b' string 30 has a diameter of 0.013 inches, and the 'high e' string 32 has a diameter of 0.010 inches. These are approximate dimensions that may vary depending upon the string design and other well known factors in the prior art. Thus, an example of the typical variations for the 'low E' string 22 are string diameters which vary from 0.040 inches to 0.052 inches.

The strings 15 are maintained in proper order and spacing along the stringed instrument 10 by the supporting elements. The first supporting element positions one end of the strings 15 and is commonly referred to as a nut 20 that is affixed between the fingerboard 14 and head 16. The second supporting element supports the other end of the strings 15 and is commonly referred to as a bridge 18. As an example of a string mounting arrangement for the 'low E' 22 string, the first end 21 of the 'low E' 22 string is attached to tuning keys 17 affixed in rotating engagement to the head 16 of the instrument and at the opposite end 23 the 'E' 22 string is attached to the body 12 of the stringed instrument 10 at a securing member 13 adjacent to the bridge 18. The 'low E' string 22 passes from the tuning key 17, over the nut 20, parallel to the fingerboard 14, over the body 12, across the bridge 18 and is affixed to the securing member 13. The bridge 18 and the nut 20 are formed with a plurality of equidistant notches 50 and apertures 52 conforming to the diameter of each string. These notches 50 and apertures 52 receive and maintain the strings 15 in the proper sequence and spacing relative to each other and at the optimum distance above the body portion 12 and fingerboard 14. For instance, the 'low E' string notch 34 that receives the 'low E' string 22, the string with the largest diameter, is formed with a 'low E' string aperture 35 that is similar in diameter to that of the 'low E' string 22. On the other hand, the 'high e' string notch 44 that receives the 'high e' string 32, the string with the smallest diameter, is formed with a 'high e' string aperture 45 suitably sized to maintain the small 'high e' string 32 within the bridge 18.

As illustrated in FIG. 2, the bridge 18 is constructed with a plurality of notches 50 and apertures 52 that are located in specific positions 54, 56, 58, 60, 62, 64 which are designed to accommodate the varying diameters of the strings 15. In the sixth position 54 is a 'low E' string notch 34 and 'low E' string aperture 35 which receives the 'low E' string 22. The 'low E' string 22 is also known as the sixth string 22, the 'low E' string notch 34 is also known as the sixth string notch 34, and the 'low E' string aperture 35 is also known as the sixth string aperture 35. In the fifth position 56 is a 'low A' string notch 36 and 'low A' string aperture 37 which receives the 'low A' string 24. The 'low A' string 24 is also known as the fifth string 24, the 'low A' string notch 36 is also known as the fifth string notch 36, and the 'low A' string aperture 37 is also known as the fifth string aperture 37. In the fourth position 58 is a 'd' string notch 38 and 'd' string aperture 39 which receives the 'd' string 26. The 'd' string 26 is also known as the fourth string 26, the 'd' string notch 38 is also known as the fourth string notch 38, and the 'd' string aperture 39 is also known as the fourth string aperture 39. In the third position 60 is a 'g' string notch 40 and 'g' string aperture 41 which receives the 'g' string 28. The 'g' string 28 is also known as the third string 28, the 'g' string notch 40 is also known as the third string notch 40, and the 'g' string aperture 41 is also known as the third string aperture 41. In the second position 62 is a 'high b' string notch 42 and 'high b' string aperture 43 which receives the 'high b' string 30. The 'high b' string 30 is also known as the second string 30, the 'high b' string notch 42 is also known as the second string notch 42, and the 'high b' string aperture 43 is also known as the second string aperture 43. In the first position 64 is a 'high e' string notch 44 and 'high e' string aperture 45 which receives the 'high e' string 32. The 'high e' string 32 is also known as the first string 32, the 'high e' string notch 44 is also known as the first string notch 44, and the 'high e' string aperture 45 is also known as the first string aperture 45. The positions are sequentially arranged so that the first position 64 is next to the second position 62, the second position 62 is next to the third position 60, the third position 60 is next to the fourth position 58, the fourth position 58 is next to the fifth position 56, and the fifth position 56 is next to the sixth position 54. The first position 64 is generally considered to be the most downward position on a downstroke across the strings 15. The nut 20 retains the strings 15 with a similar method and construction.

In this manner, the following music intervals are produced: perfect fourth intervals between 'low E' string 22 and 'low A' string 24, between 'low A' string 24 and 'd' string 26, and between 'd' string 26 and 'g' string 28: major third interval between 'g' string 28 and 'high b' string 30; and perfect fourth interval between 'high b' string 30 and 'high e' string 32. As a result of the sequence with which the strings 15 are attached to the instrument 10, the instrument 10 produces a unique and distinctive sound. This sound can be varied to some degree by tuning individual strings 15. However, the player soon learns that the instrument 10 is limited in its ability to produce unusual melodies and harmonies during conventional playing. A player may attempt to produce unique sounds by varying the sequence of striking the strings 15 in order to produce new music intervals. However, this procedure ultimately may produce a haphazard and undesirable effect.

Numerous designs for improving the performance of string instruments have been provided in the prior art. Several of these designs are covered by U.S. patents such as: U.S. Pat. No. 4,483,233, issued to Benson, on Nov. 20, 1984; U.S. Pat. No. 5,485,773, issued to Devitrysmith, on Jan. 23, 1996; U.S. Pat. No. 5,760,320, issued to Gooday, on Jun. 2, 1998; U.S. Pat. No. 5,780,758, issued to McGill, on Jul. 14, 1998; and U.S. Pat. No. 5,801,319, issued to Hebestreit, et al. on Sep. 1, 1998. Benson discloses a combined guitar and bass guitar having eight strings. Devitrysmith teaches a guitar string installation and adjustment mechanism. A stringed instrument, disclosed Gooday, presents a novel means for tuning individual strings that incorporates in part a unique rotatable winding peg and rotatable adjusting handle coupled to the winding peg. Gooday presents a novel means for tuning individual strings that incorporates in part a unique rotatable winding peg and rotatable adjusting handle coupled to the winding peg. McGill discloses mechanical innovations for resonator guitars and other musical instruments, and Mebestreit et al. reveals an improved construction for strings for musical instruments. Each of these patents is hereby incorporated by reference.

As illustrated by the background art, efforts are continuously being made in an attempt to develop devices that improve the performance of stringed instruments, such as guitars and the like. No prior effort, however, provides the benefits attendant with the present invention. As such, it may be appreciated that there is a continuing need to produce novel and unusual sounds from stringed instruments in a manner that is similar to that of playing a conventional stringed instrument. In these respects, the present version of the invention substantially departs from the conventional concepts and designs of the prior art, and in so doing provides an apparatus that substantially fulfills this need. Additionally, the prior patents and commercial techniques do not suggest the present inventive combination of component elements arranged and configured as disclosed herein. The present invention achieves its intended purposes, objects, and advantages through a new, useful and unobvious combination of method steps and component elements, with the use of a minimum number of functioning parts, at a reasonable cost to manufacture, and by employing only readily available materials.

What is needed then to overcome the aforementioned limitations of conventional stringed instruments is the provision of a stringed instrument that is fitted with strings that vary in sequence from the usual string size order. Such a variation would consist of reversing the order of a portion of said strings in order to produce easily formed close harmonic chords and the desired novel and unusual harmonies and melodies while said instrument is played as a conventional instrument.

SUMMARY OF THE INVENTION

The present version of the invention, which will be described in greater detail hereinafter, relates to the field of constructing stringed instruments. More specifically, this version of the invention is concerned with constructing stringed instruments such as guitars in a manner that varies the order of the placement of the strings in order to produce new and novel sounds while playing the instrument in a conventional method. The present invention overcomes all of the shortcomings of the prior art and provides some additional novel aspects that will be described in detail hereinafter.

Described briefly, according to a typical embodiment, the invention presents a method and construction for producing unusual harmonies and melodies from conventional stringed instruments such as guitars by varying the sequence of order of strings that are attached to the instrument. Conventional guitars employ six strings the first string is tuned to 'high e', the second string is tuned to 'high b', the third string is tuned to 'g', the forth string is tuned to 'd', the fifth sting is tuned to 'low A', and the sixth string is tuned to 'low E'. Each string is attached at one end to a rotating tuning mechanism at the head of said instrument and attached at the other end to the body of the instrument proximate to a bridge. The bridge and a nut maintain the strings in the proper sequence and spacing relative to each other and at the optimum distance above the body and fingerboard of the instrument. The strings also proceed sequentially with a string of a largest diameter (string tuned 'low E') to a string of least diameter (string tuned 'high e'). Appropriately sized notches and apertures formed within the nut and bridge secure the strings in proper alignment and spacing. The method and construction of the instant invention reverses the location of four of the strings and maintains the original position of two of the strings. As such, the location of the first and sixth strings tuned 'low E', and 'high e' are reversed, and the location of second and fifth strings are reversed. The second string is then tuned to an 'high a' where before it was tuned to a 'high b', and the fifth string is now tuned to a 'low B' where before it was tuned to an 'low A'. Thus, when the fifth string is placed in the second string position, the fifth string is tuned a whole tone higher than it was tuned to in the fifth string position. Similarly, when the second string is placed in the fifth string position, the second string is tuned a whole note lower than it was tuned in the second string position. Thus, the aforementioned strings have been relocated from their original positions, and the revised tuning sequence of the strings has the actual tuning nomenclature of: 'high e', 'high a', 'd', 'g', 'low B', and 'low E'.

For playing purposes, the instrument is played as if the strings have not been relocated from their original positions. The stringed instrument of the instant invention is thus played in the normal technique, i.e. conventional fingering, while allowing the player to elicit altered pitch levels from the partially reversed order of the strings. This revised positioning allows the player to produce heretofore unattainable melodies and harmonies without learning new fingering positions or playing techniques. Revised hardware is also provided for the reversal of the string positions, such as changes in the notches and apertures of the bridge and nut which are modified to maintain the strings in the revised sequence. My invention, therefore, is distinguished from the prior art in this particular combination of all of its structures for the functions specified.

Accordingly, it is an object of my version of the invention to provide a low-cost, easy-to-manufacture, and easy-to-market method of constructing revised position stringed instruments.

A further object of my version of the invention is to provide an easy-to-use and versatile method of constructing stringed instruments. A significant object of the invention is to provide a method of constructing stringed instruments that can be adapted to a variety of instruments that employ a sequenced arrangement of tuned strings.

A final but very significant object or the invention is to provide a method of construction of stringed instruments that partially reverses the size order of tuned strings in order to yield new and unusual harmonies and melodies while playing the instrument in a conventional manner.

The foregoing and other objects, features and advantages of the invention will become more fully understood from the following description of the preferred embodiment of the invention as illustrated in the accompanying drawings in which like reference characters refer to the same parts throughout different views. The drawings are not necessarily to scale, emphasis instead being placed upon illustrating the principles of the invention.

DESCRIPTION OF THE PREFERRED EMBODIMENTS

Figure 1:
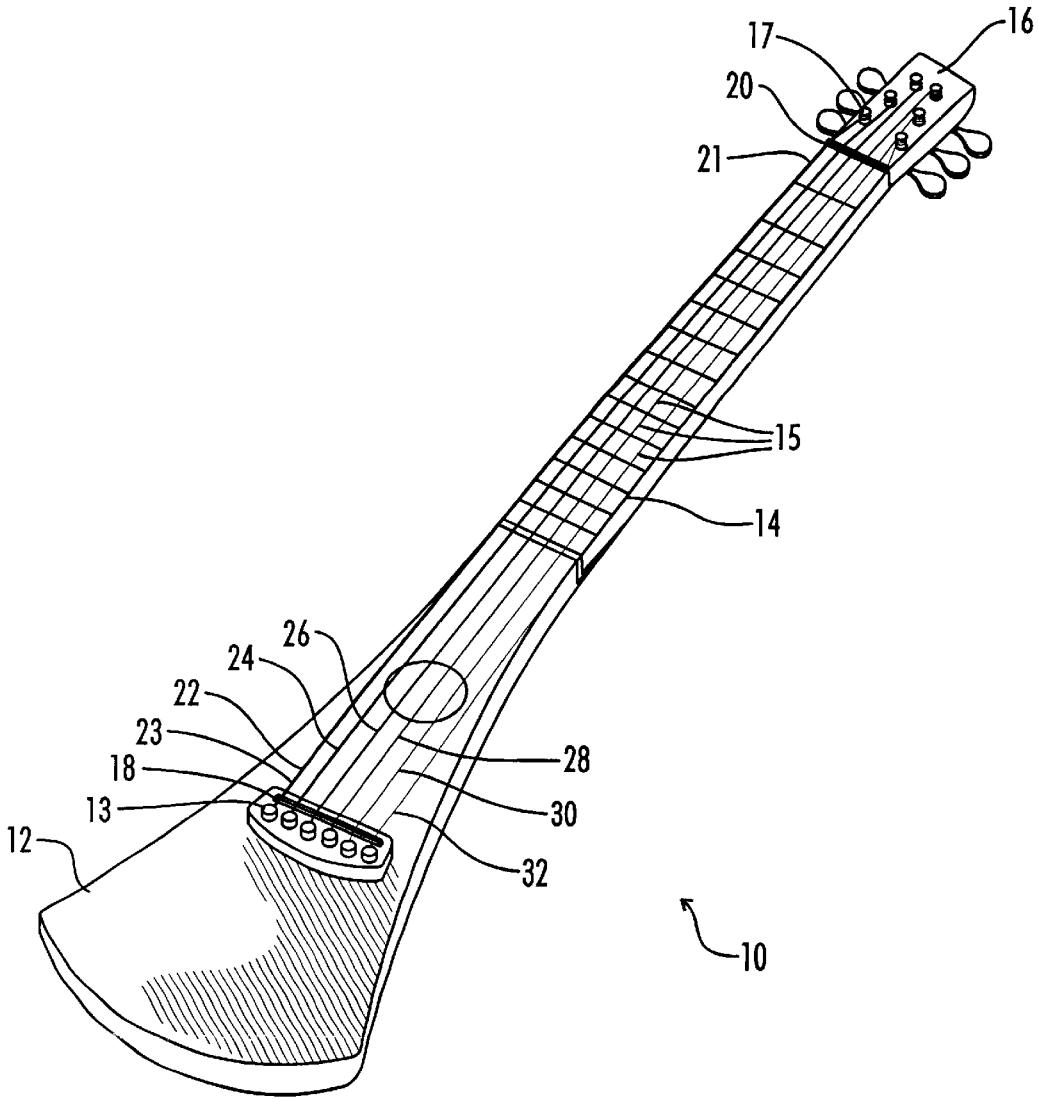
FIG. 1 (PRIOR ART)
FIG. 1 is a perspective view of a conventional stringed guitar.
Figure 2:
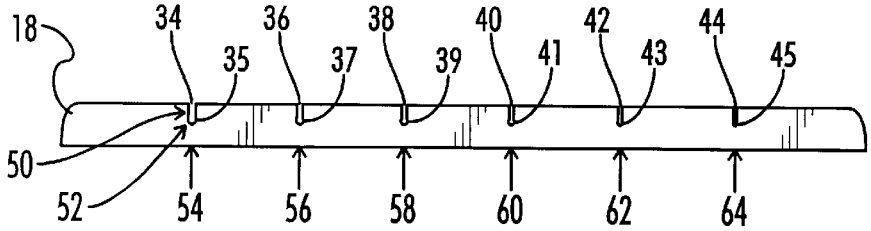
FIG. 2 (PRIOR ART)
FIG. 2 is a side elevation view of a bridge of a conventional stringed guitar.
Figure 3:
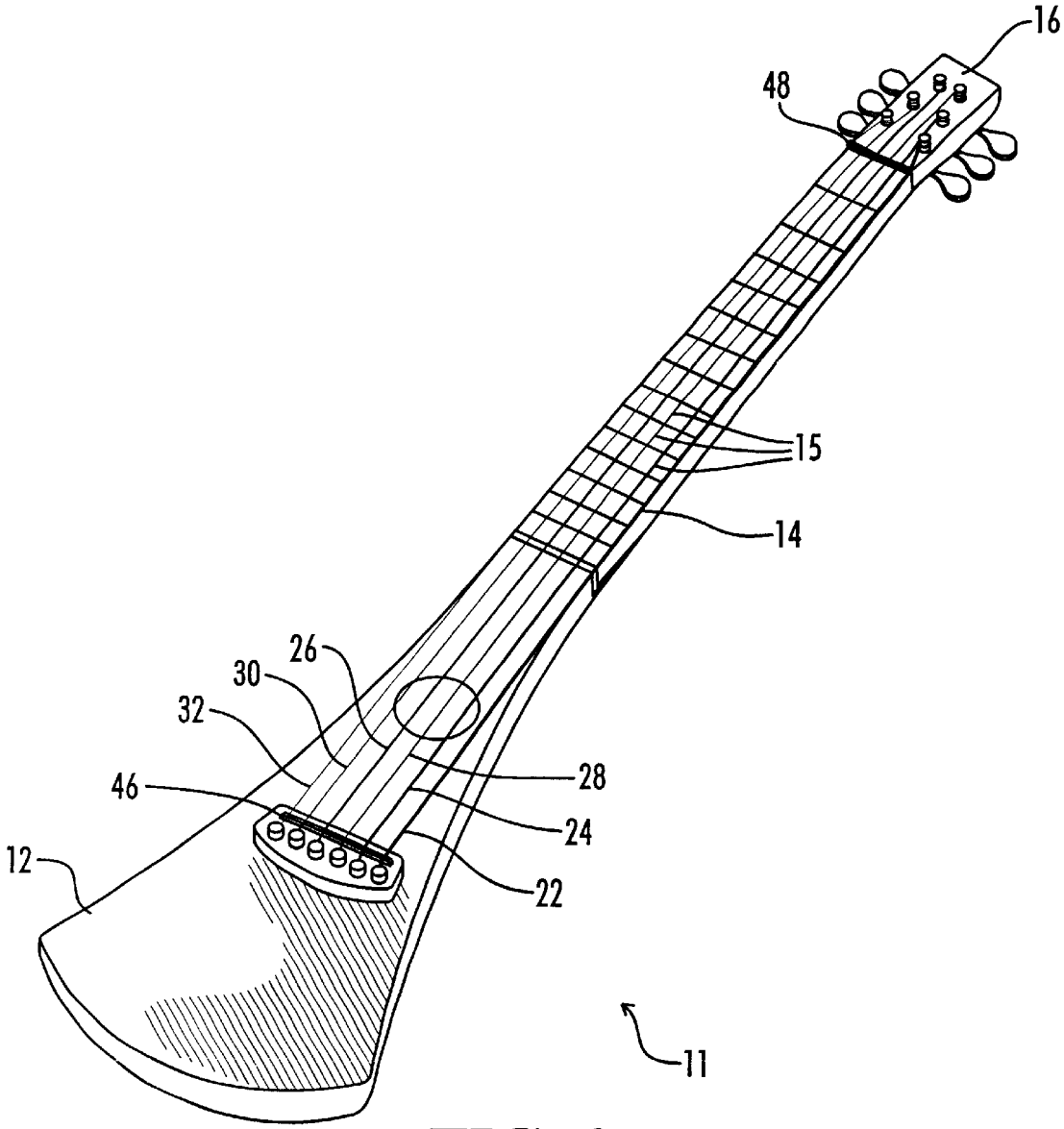
FIG. 3 is a perspective view of a stringed guitar constructed in accordance with the present version of the invention.

Referring to FIG, 3, therein illustrated is the alternate stringed guitar 11 of the instant invention. This invention teaches a tuned string arrangement for a stringed instrument or guitar with the tuned string arrangement utilizing a tuning sequence of 'high e', 'high a', 'd', 'g', 'low B', and 'low E'. Four guitar strings are reversed from their standard positions with sixth string 22 and first string 32 reversed from their standard positions, and the fifth string 24 and second string 30 reversed from their standard positions. In this manner, the standard location of the narrowest diameter guitar string, the first string 32, is occupied by the widest guitar string, the sixth string 22 and vice versa. In addition, the location of the fifth narrowest diameter guitar string 30, is occupied by the fifth widest guitar string 24 and vice versa. The positions of the fourth string 26 and third string 28 are unchanged from that of the conventional stringed instrument 10. The aforementioned strings 15 have been relocated and reversed with respect to their original positions and each string continues to be tuned to the note letter name that it would have been tuned to in a standard configuration although the note may be different by an octave or more. In this manner, the sixth string in the first position is still tuned to the sixth string note of 'low E'. The fifth string in the second position is tuned to the note of 'low B', although this is an octave lower than the original note for this string position. The fourth string is still tuned to 'd' in the fourth position, and the third string is still tuned to 'g' in the third position. The second string is tuned to a 'high a' in the fifth position which is an octave higher than the original note for this string position. Finally, the first string is still tuned to the first string note of 'high e' in the sixth position.

The supporting elements, including the bridge 46 and the nut 48 are modified accordingly to accommodate the size of the strings 15 in their new revised sequence. Because the modifications to the bridge 46 and the nut 48 are so similar, the following discussion will outline the modification to the bridge 46 which will also be applicable to the nut 48, and thus, it may be seen that the string positions on the nut 48 will also be modified in a similar manner to the bridge modifications.

Figure 4:
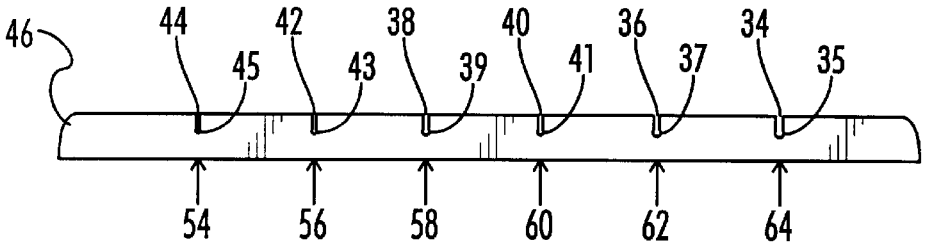
FIG. 4 is a side elevation view of a bridge of a stringed guitar constructed in accordance with the present version of the invention.

As illustrated in FIG. 4, the modified bridge 46 functions as follows. A first notch 44 and first aperture 45 receives the first and narrowest string 32 in the sixth string position 54. This first string 32 is tuned to the 'high e' note. A second notch 42 and second aperture 43 receives the second and next narrowest string 30 in the fifth string position 56. The second string is tuned to the 'high a' note a tone lower than the original 'high b' note usually associated with this string. A fourth notch 38 and fourth aperture 39 receives the fourth string 26 in the fourth string position 58. The fourth string continued to be tuned to the 'd' note. A third notch 40 and third aperture 42 receives the third string 28 in the third string position 60, and this third string 28 continues to be tuned to the 'g' note. A fifth notch 36 and fifth aperture 37 receives the fifth and next to widest string 24 in the second string position 62. The fifth string 24 is tuned to the 'low B' note a tone higher than is normally used for the fifth string. Finally, a sixth notch 34 and sixth aperture 34 receives the sixth, or widest, string 22 in the first string position 64, which is still tuned to the 'low E' note. Retaining the fourth 26 and third 28 strings in conventional size order allows easy formation of close harmonic chords while the revised sequence of strings 32, 30, 24, 22 permits novel and unique melodies and harmonies to be achieved.

Figure 5:
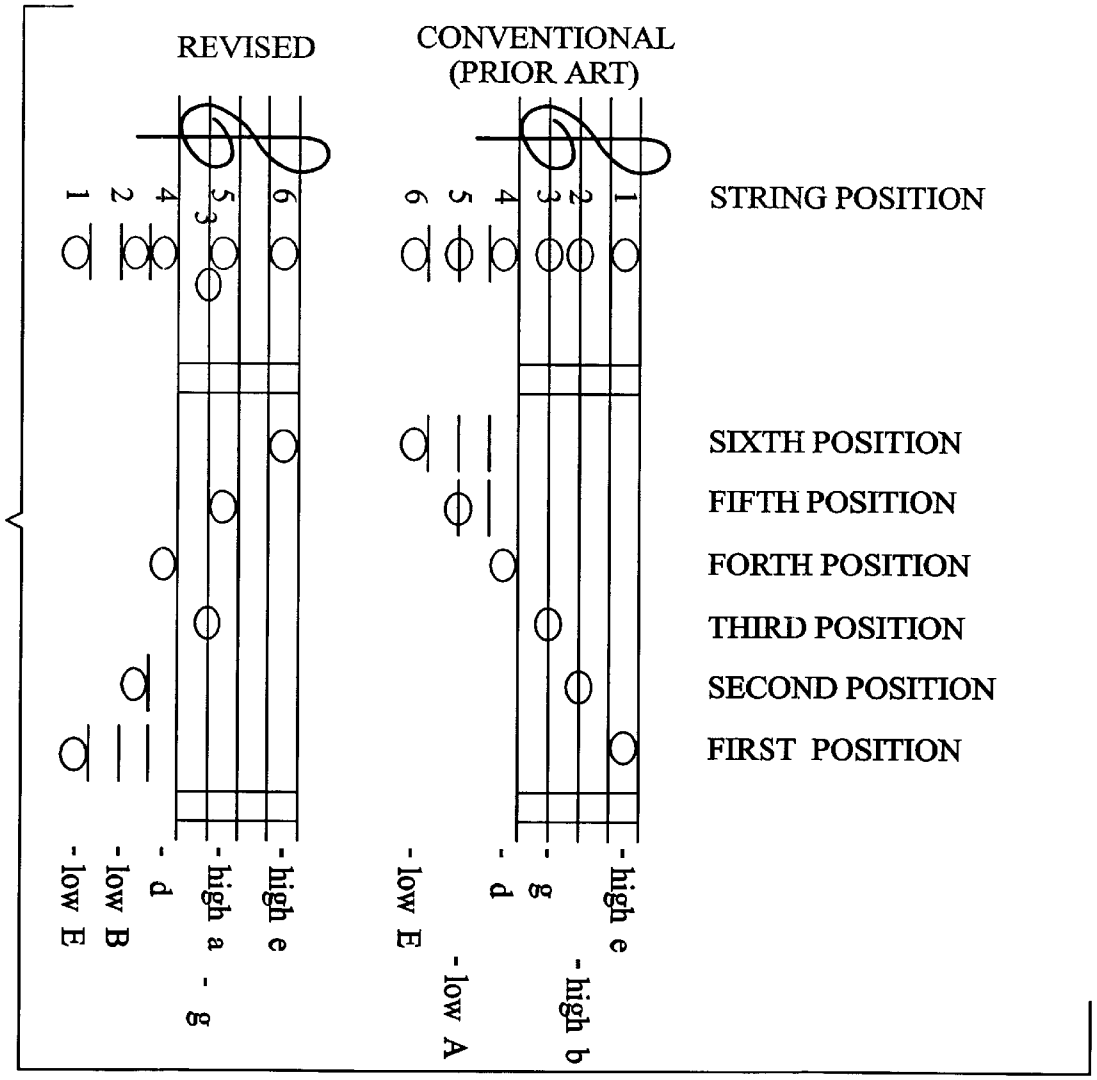
FIG. 5 is a schematic sheet music diagram showing the new tuning sequence of the strings on the guitar of the present invention.

FIG. 5 shows the relation between the tuning position of the strings for the conventional guitar and the new string arrangement for the present invention. In this manner, the improved chordal and arpeggios forms are illustrated. With this new tuning sequence, the following revised music intervals are produced by the present invention. A perfect fifth interval between first string 32 tuned to a 'high e' in the sixth string location 54 and second string 30 tuned to a 'high a' in the fifth string location 56. A perfect fifth interval between the second string 30 tuned to an 'high a' in the fifth string location 56 and the fourth string 26 tuned to a 'd' in the fourth string location 58. A perfect fourth interval between the fourth string 26 tuned to a 'd' in the fourth string location 58 and the third string 29 tuned to a 'g' in the third string location 60. A minor sixth interval between the third string 29 tuned to a 'g' in the third string location 60 and the fifth string 24 tuned to a 'low B' in the second string location 62. Finally, a perfect fifth interval between the fifth string 24 tuned to a 'low B' in second string location 62 and sixth string 22 tuned to a 'low E' in the first string location 64.

Thus, the conventional guitar and the present invention both utilize a two octave range in the open string position between the smallest and largest strings. However, the music intervals and positions of the strings are changed from the conventional guitar to allow for the guitarist to easily form and play chords and harmonies that would be physically impossible on a conventional guitar. While the inside open four strings of the conventional guitar encompass the music interval of one octave and a major second-major ninth, the inside open four strings of the instant invention encompass the considerably smaller music interval of a minor seventh. This closeness of intervals allows the guitarist to easily form and play chords and harmonies that are physically impossible to form or play on the conventional guitar. This is shown in the illustration of the chordal form as shown in FIG. 5.

In this manner, the invention presents a string size order rearrangement for non-sequential string-size placement. This presents and allows a different guitar tuning than may be performed by typical alternate guitar tunings that utilize strings placed in the same locations as a conventional guitar. Thus, the present invention provides for re-arrangement of the guitar strings except for the third and fourth strings with re-tuning of the second and fifth strings. This allows for the string placements to retain their original note names to present a new guitar tuning with playing advantages over the prior art string arrangements.

It will be appreciated by those skilled in the art that my invention is not an alternate guitar tuning (alternate tunings have string note changes), but rather, is an improvement in string size order—i.e., all strings retain their conventional guitar note names (are tuned to the same note names that they were tuned to in their original placement), but the string sizes are rearranged except for strings in the number 3 and 4 positions.

Thus, although there have been described particular embodiments of the present invention of a new and useful Method of Constructing Stringed Instruments, it is not intended that such references be construed as limitations upon the scope of this invention except as set forth in the following claims.

What is claimed is:

1. A revised string arrangement for a musical instrument utilizing a first string with a first diameter, a second string with a second diameter larger than the first diameter, a third string with a third diameter larger than the second diameter, a fourth string with a fourth diameter larger than the third diameter, a fifth string with a fifth diameter larger than the fourth diameter, and a sixth string with a sixth diameter larger than the fifth diameter, wherein the strings are selectively placed into a string placement arrangement including a first position, a second position adjacent to the first position, a third position adjacent to the second position, a fourth position adjacent to the third position, a fifth position adjacent to the fourth position, and a sixth position adjacent to the fifth position, comprising:

the first string placed in a sixth position;

the second string placed in the fifth position;

the fourth string placed in the fourth position;

the third string placed in the third position;

the fifth string placed in the second position; and the sixth string placed in the first position.

2. The revised string arrangement of claim 1, wherein the first string is tuned to the 'high e' note;

the second string is tuned to the 'high a' note;

the fourth string is tuned to the 'd' note;

the third string is tuned to the 'g' note;

the fifth string is tuned to the 'low B' note; and the sixth string is tuned to the 'low E' note.

3. A string arrangement for a musical instrument utilizing strings normally tuned to 'low E', 'low A', 'd', 'g', 'high b', and 'high e' and string positions including a first position at the bottom of a downstroke when the instrument is played, a second position adjacent to the first position, a third position adjacent to the second position, a fourth position adjacent to the third position, a fifth position adjacent to the fourth position, and a sixth position adjacent to the fifth position, the revised string arrangement comprising:

the 'high e' string attached in the sixth position;

the 'high b' string tuned to a 'high a' and attached in the fifth position;

the 'd' string attached in the fourth position;

the 'g' string attached in the third position;

the 'low A' string tuned to a 'low B' and attached in the second position; and the 'low E' string attached in the first position.

4. A stringed instrument, comprising:

a body section;

a fingerboard with a first end and a second end, the second end attached to one end of the body section;

a head attached to the first end of the fingerboard;

a bridge attached to the body section;

a nut attached in association with the first end of the fingerboard;

a plurality of different sized strings supported by the bridge and the nut, wherein the strings are arranged in an order that is not sequentially arranged according to the size of the string; wherein the strings include a 'high e' string, a 'high b' string, a 'd' string, a 'g' string, a 'low A' string, and a 'low E' string.

5. The stringed instrument of claim 4, wherein the non-size sequential order includes the 'high e' string located next to the 'high b' string located next to the 'd' string located next to the 'g' string located next to the 'low A' string located next to the 'low E' string, wherein the 'high b' string is tuned to a 'high a' note and the 'low A' string is tuned to a 'low B' note.

6. A supporting element arrangement for a musical instrument utilizing a first notch, a second notch larger than the first notch, a third notch larger than the second notch, a fourth notch larger than the third notch, a fifth notch a fourth notch, and a sixth notch larger than the fifth notch, wherein the notches are selectively placed into a notch placement arrangement including a first position, a second position adjacent to the first position, a third position adjacent to the second position, a fourth position adjacent to the third position, a fifth position adjacent to the fourth position, and a sixth position adjacent to the fifth position, the revised bridge comprising:

the first notch placed in a sixth position;

the second notch placed in the fifth position;

the fourth notch placed in the fourth position;

the third notch placed in the third position;

the fifth notch placed in the second position; and the sixth notch placed in the first position.

7. The supporting element arrangement of claim 6, further comprising:

a sixth aperture connected to the sixth notch;

a fifth aperture connected to the fifth notch;

a fourth aperture connected to the fourth notch;

a third aperture connected to the third notch;

a second aperture connected to the sixth second; and a first aperture connected to the first notch.

8. A tuned string arrangement for a musical instrument with a first string location, a second location adjacent to the first location, a third location adjacent to the second location, a fourth location adjacent to the third location, a fifth location adjacent to the fourth location, and a sixth location adjacent to the fifth location, the tuned string arrangement comprising:

a perfect fifth interval between the sixth string location and the fifth string location;

a perfect fifth interval between the fifth string location and the fourth string location;

a perfect fourth interval between the fourth string location and the third string location;

a minor sixth interval between the third string location and the second string location; and a perfect fifth interval between the second string location and the first string location.

9. A tuned string arrangement for a guitar, the tuned string arrangement comprising a tuning sequence of 'high e', 'high a', 'd', 'g', 'low B', and 'low E'.

* * * * *